US006234315B1

(12) United States Patent
Karpisek

(10) Patent No.: US 6,234,315 B1
(45) Date of Patent: May 22, 2001

(54) COLLAPSIBLE CONTAINER WITH DETACHABLY HINGED SIDE PANELS

(76) Inventor: Ladislav Stephan Karpisek, 86 Woodfield Boulevarde, Caringbah, New South Wales 2229 (AU)

( * ) Notice: Subject to any disclaimer, the term of this patent is extended or adjusted under 35 U.S.C. 154(b) by 0 days.

(21) Appl. No.: 09/555,346

(22) PCT Filed: Nov. 18, 1998

(86) PCT No.: PCT/AU98/00960

§ 371 Date: May 23, 2000

§ 102(e) Date: May 23, 2000

(87) PCT Pub. No.: WO99/26851

PCT Pub. Date: Jun. 3, 1999

(30) Foreign Application Priority Data

Nov. 25, 1997 (AU) ..... PP0529

(51) Int. Cl.[7] ..... B65D 19/00

(52) U.S. Cl. ..... 206/600; 220/4.34

(58) Field of Search ..... 206/386, 600; 220/4.28, 4.33, 4.34

(56) References Cited

U.S. PATENT DOCUMENTS 6,019,226 * 2/2000 Zajdlik et al. ..... 206/600

* cited by examiner

*Primary Examiner*—David T. Fidei
(74) *Attorney, Agent, or Firm*—Edwin D. Schindler

(57) ABSTRACT

A collapsible container including a base (1) and four side panels (15, 16, 17, 18) with u-shaped links (41) coupling the side panels to the base (1) to enable the side panels (15, 16, 17, 18) to fold down over the base (1) to a storage position from a use position where the side panels (15, 16, 17, 18) are interconnected and upstanding from the base (1). Spring means (46) bias first link spigot (43), located in sleeve (48) attached to the base, to retain second link spigot (44) in saddle (49) attached to the panel. The panel is detached by applying counter effort to link body (42) and spring (46) to withdraw the second link spigot (44) from saddle (49).

4 Claims, 9 Drawing Sheets

Figure 1:
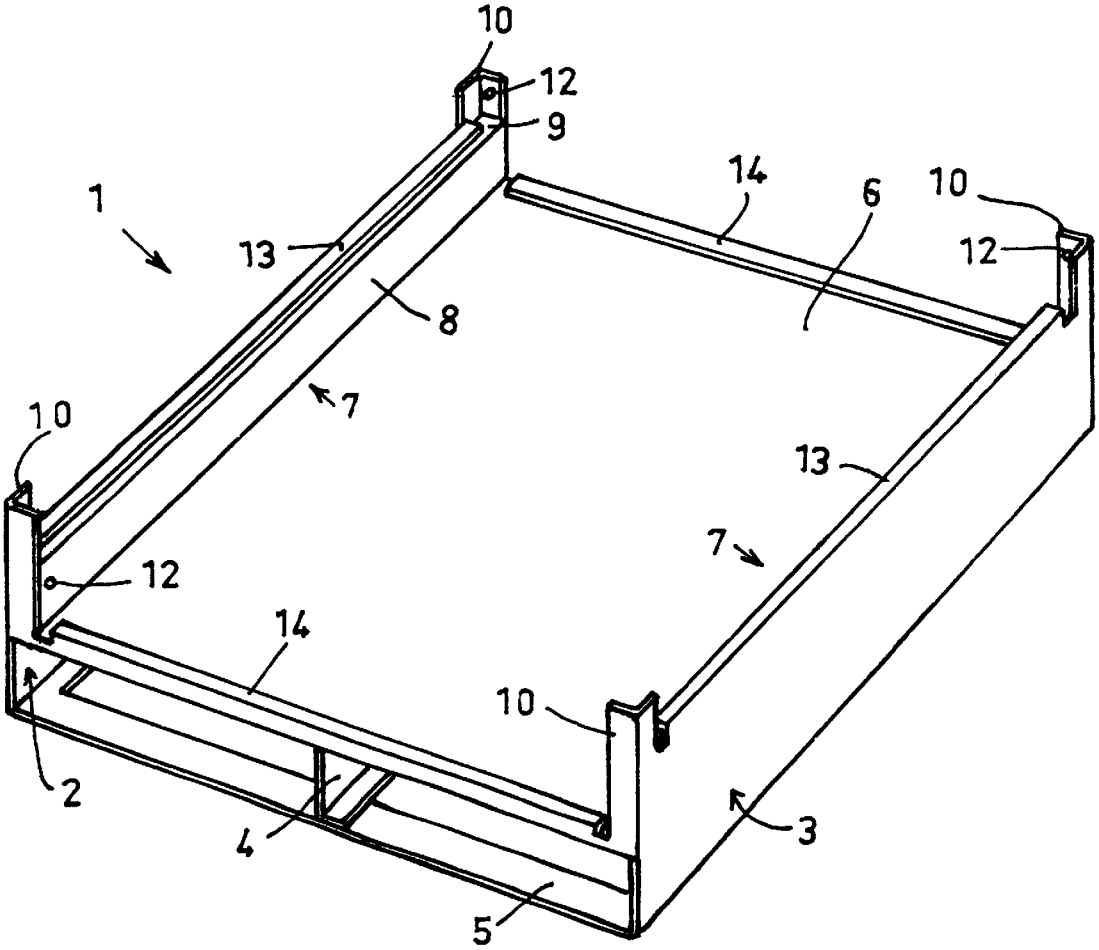

FIG. 4.
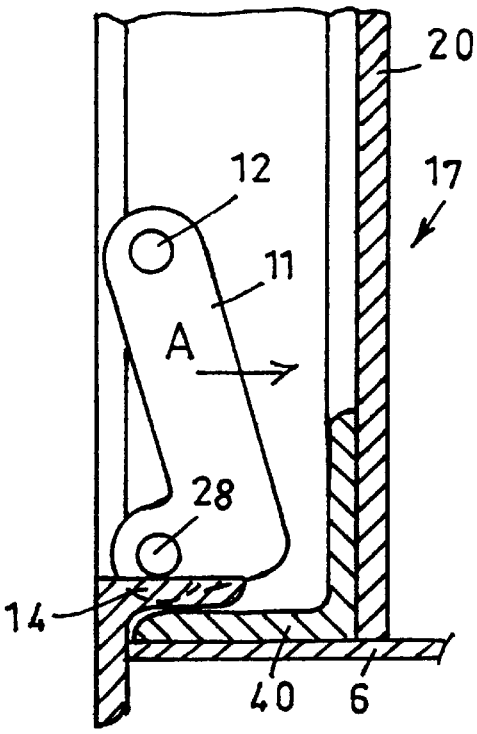
FIG. 5.
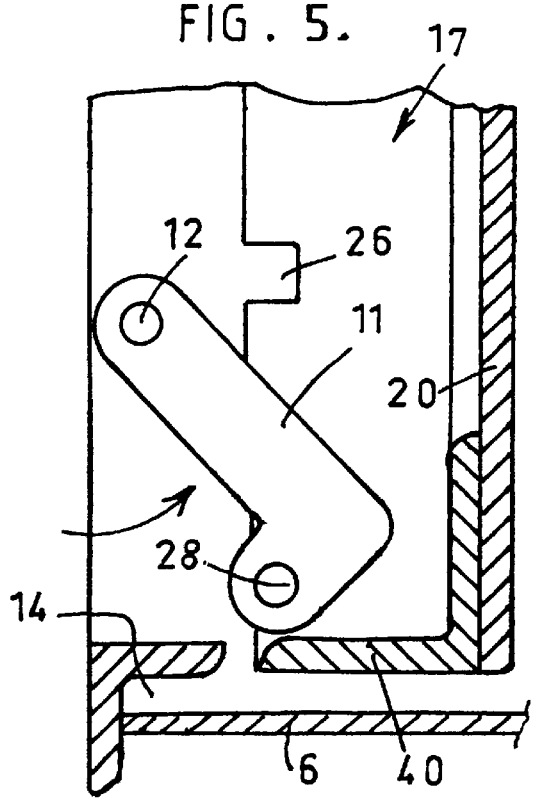
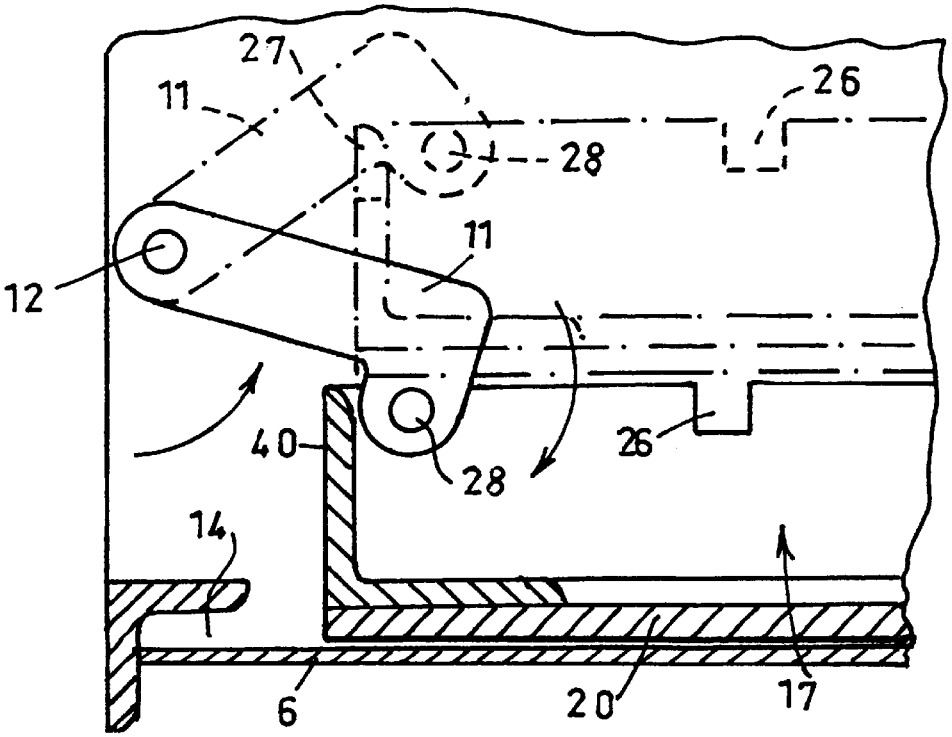
FIG. 6.

COLLAPSIBLE CONTAINER WITH DETACHABLY HINGED SIDE PANELS

FIELD OF THE INVENTION

This invention relates to collapsible containers generally and in particular to the connections between the base and side panels of collapsible containers allowing the side panels to fold down over each other and the base.

BACKGROUND TO THE INVENTION

Collapsible containers of many forms are known. One form has a base with coupled side panels which can be folded down to overlying relationship one with the others and all in overlying relationship with the base. A particular form of this type of container is disclosed in Australian patent 694001.

In that patent application there is disclosed a collapsible container having two side panel pairs where the panels of each pair lie at opposite sides of a rectangular base. The panels are all permanently connected to a base, each by two links, to permit the side panels to be lowered to the collapsed condition from an upstanding condition. In the upstanding condition the side panels are maintained by engagement of panel bottom flanges with channels on the base. By the use of coupling means the side panels when upstanding are interconnected to form an enclosure.

The links in a preferred form disclosed in Australian patent 694001 each have an elongated body with parallel end spigots respectively permanently engaged in a bearing means fixed to the base and in a slot of a saddle member fixed to a panel. This arrangement works well but does not allow removal of a side panel from the base. For thorough cleaning of the container after use it is desirable to have one, if not all, of the side panels demountable from the base.

The present invention addresses this need in a manner which will be readily understood from the following description of the accompanying drawings.

GENERAL STATEMENT OF INVENTION

Broadly, the present invention provides a collapsible container including a four sided base, four side panels connected respectively to the four sides of the base each by a pair of links allowing the side panels to be folded down from an erect position upstanding from the base into overlying relationship with each other and the base, the links of at least one side panel being releasable links allowing said one side panel to be demounted from the base, each releasable link includes a body with a first spigot and a second spigot with the spigots substantially parallel and extending in the same direction away from the body, the first spigots of said releasable links are respectively permanently engaged in bearing means on said base in a manner allowing the first spigots to pivot in said bearing means and to move in said bearing means in a direction aligned with the axis of pivoting of said first spigots, the second spigots of said releasable links are respectively engaged in tracks of said one side panel in a manner allowing said second spigots to pivot in said tracks and move along said tracks in a direction lateral to the axis of pivoting of said second spigots and to be axially withdrawn from said tracks, and biassing means for each of said releasable links to bias said first spigots to inner positions in said bearing means corresponding with engaged positions for said second spigots in said tracks, said second spigots being disengaged from said tracks to allow demounting of said one side panel from said base by axial movement of said first spigots towards outer positions in said bearing means against said biassing means.

GENERAL DESCRIPTION OF THE DRAWINGS

Figure 2:
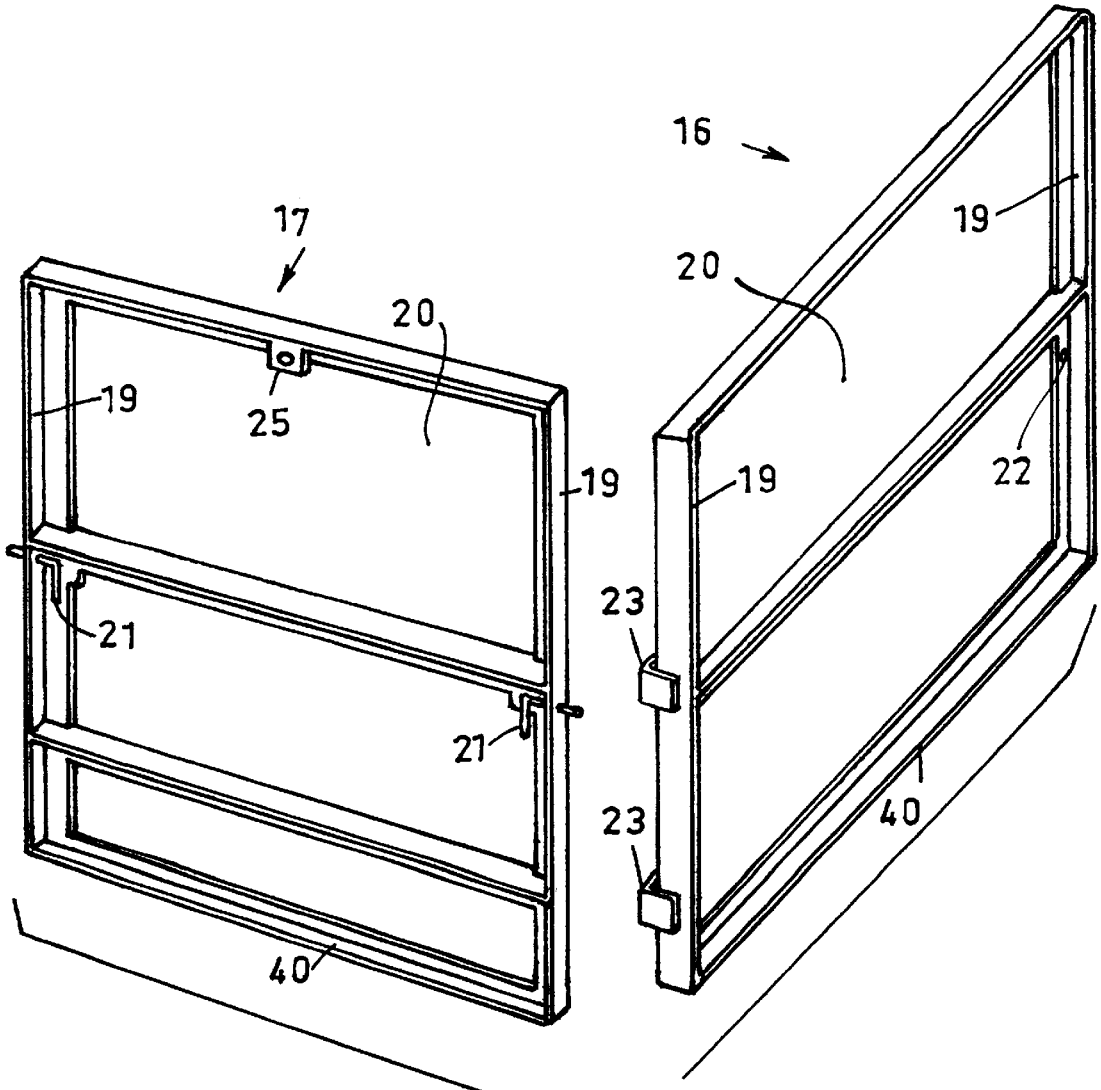
Figure 3:
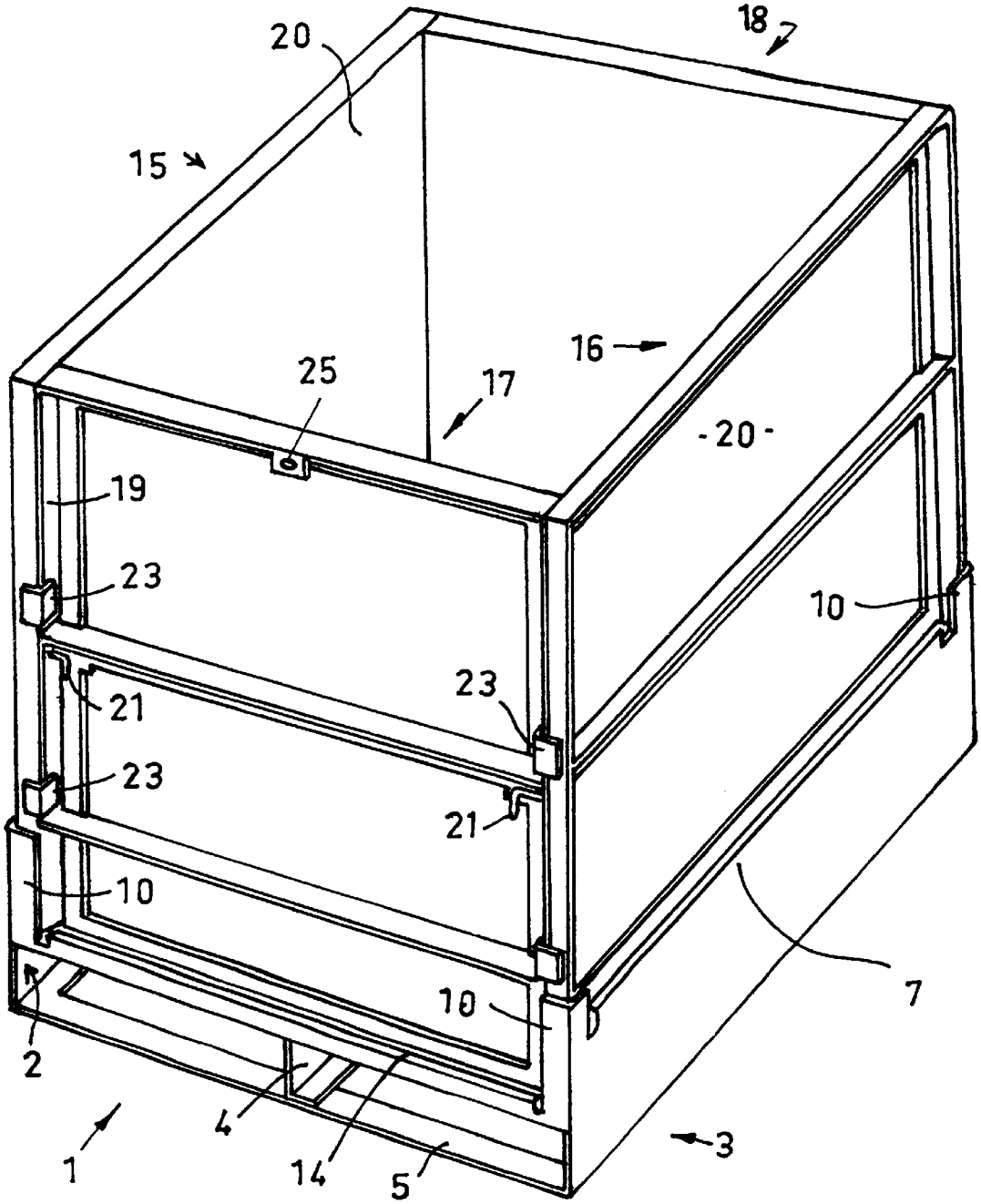
Figure 7:
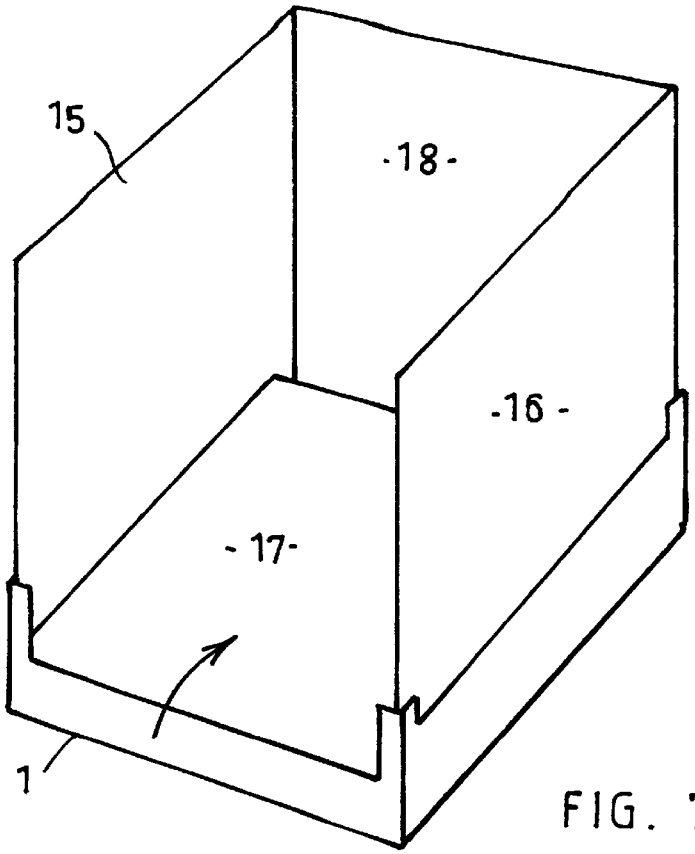
Figure 8:
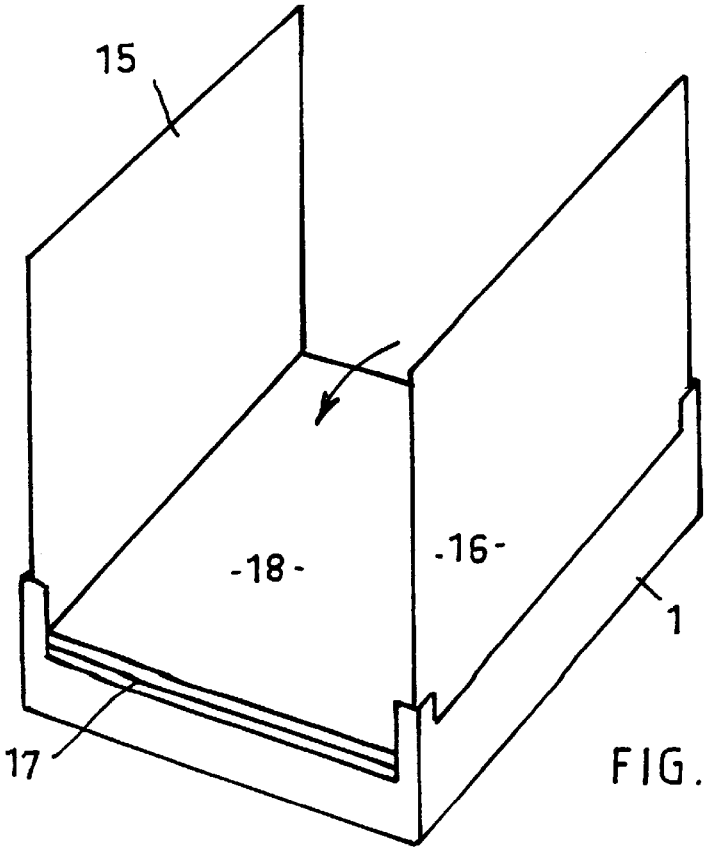
Figure 9:
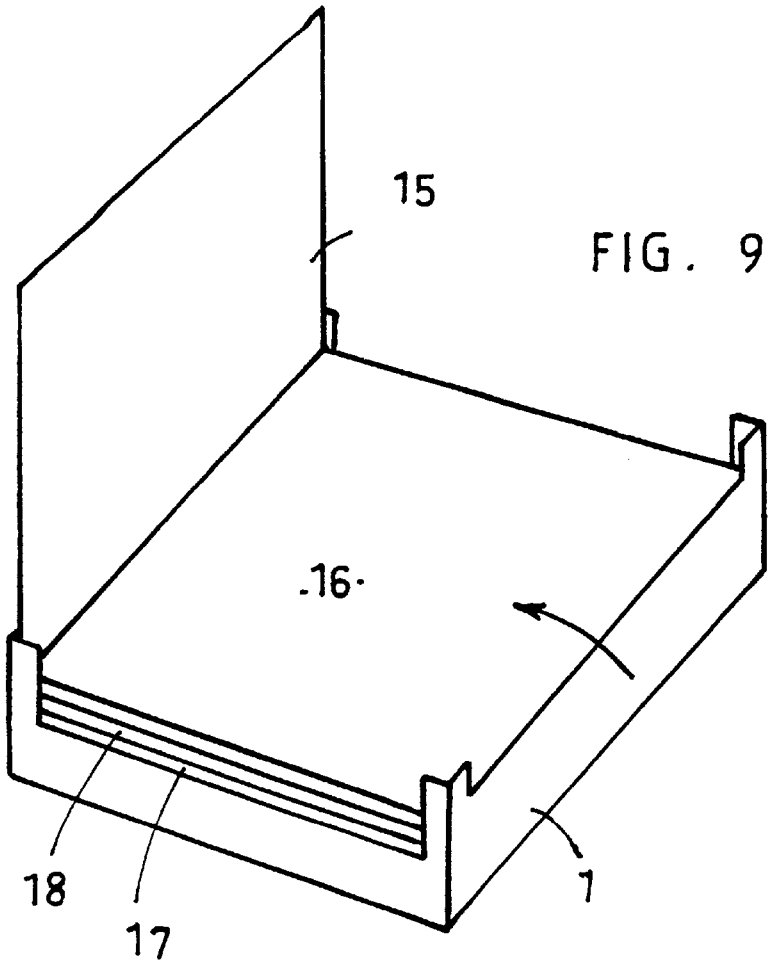
Figure 10:
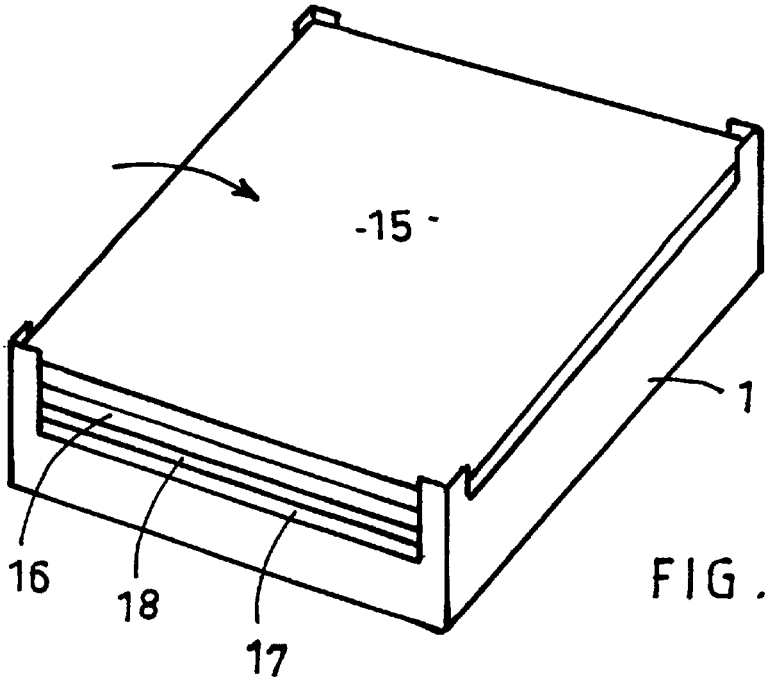
Figure 11:
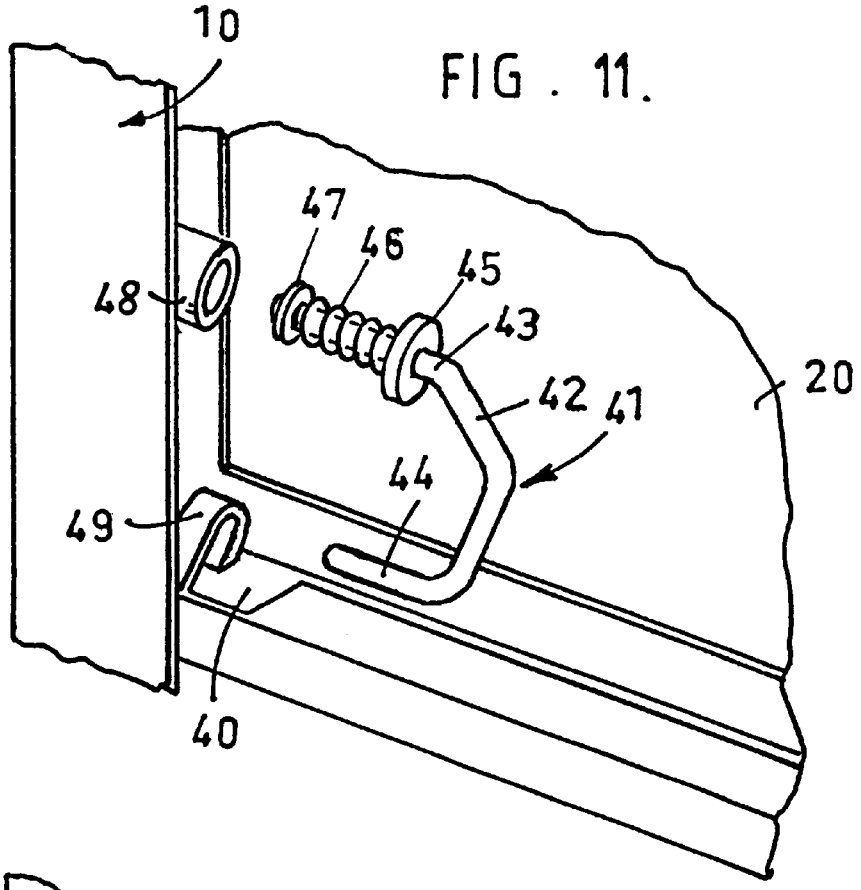
Figure 12:
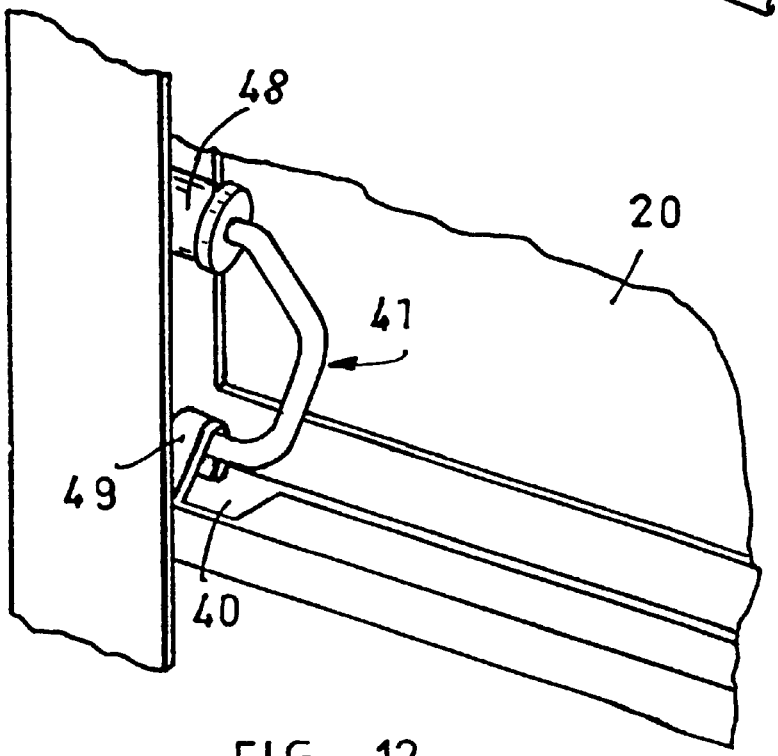
Figure 13:
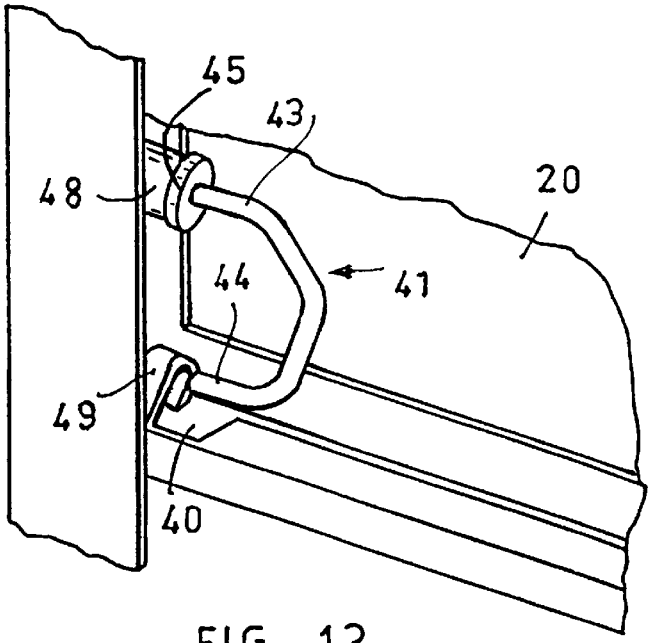
Figure 14:
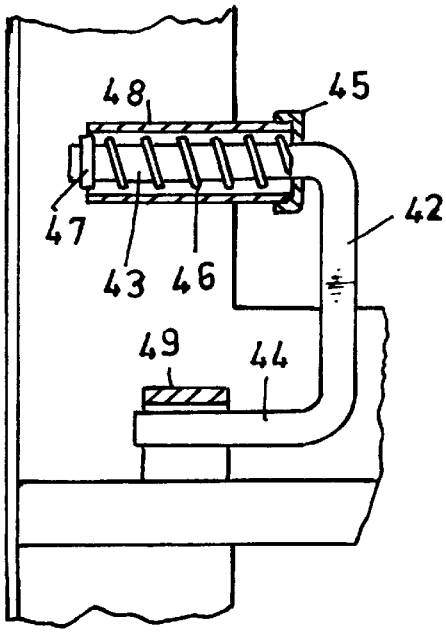
Figure 15:
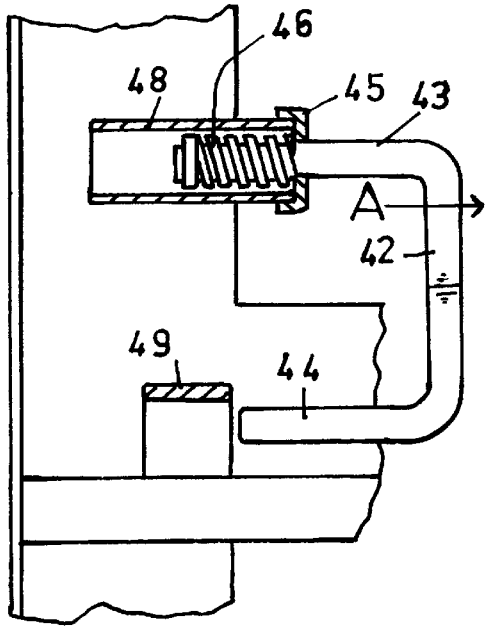
Figure 16:
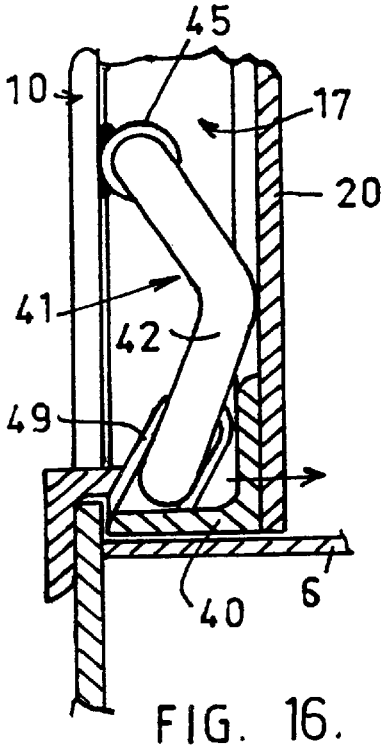
Figure 17:
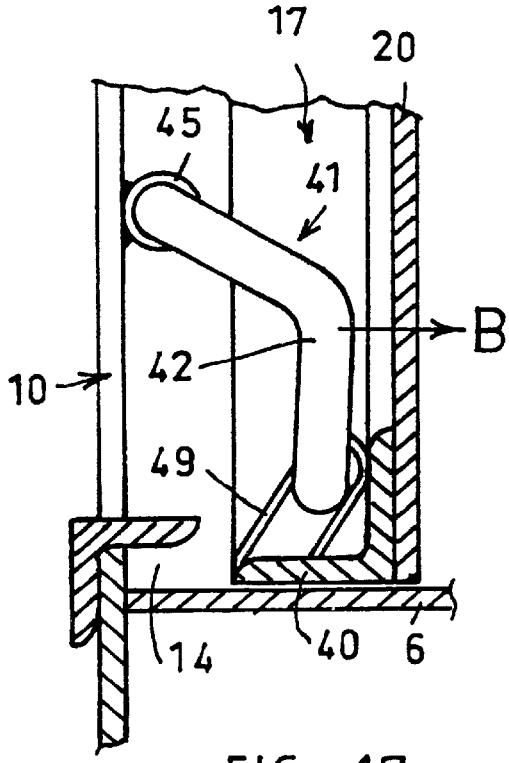
Figure 18:
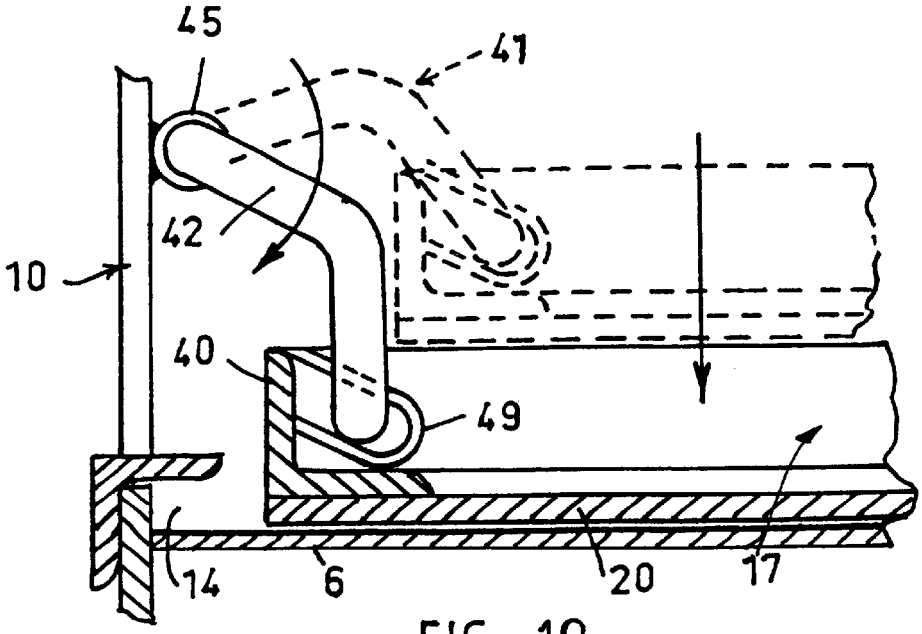

FIG. 1 is a perspective view of a base of a known form of collapsible container, FIG. 2 is a perspective view of one pair of panels for use with the base of FIG. 1, FIG. 3 is a perspective view of a container utilising the base of FIG. 1 and two pairs of panels as shown in FIG. 2, FIG. 4 is an enlarged fragmentary view of the link components for a permanent link connection between the base and a panel, with the panel upright in an operative relationship with panel mounting means of the base, FIG. 5 is a view similar to FIG. 4 where the panel is disengaged from its mounting means but still erect, FIG. 6 is a view similar to FIG. 4 where the panel is disengaged from its mounting means but folded down as part of the container collapsing process, FIG. 7 diagrammatically shows a first stage in the collapse of the container, FIG. 8 is a view similar to FIG. 7 showing the second stage in the collapse of the container, FIG. 9 is a view similar to FIG. 7 showing the third stage in the collapse of the container, FIG. 10 shows the container collapsed, FIG. 11 is an enlarged exploded and fragmentary view of link components according to this invention for demountably linking a panel to the base of a container, FIG. 12 is a view similar to FIG. 11 with the link components assembled coupling the panel to the base, FIG. 13 is a view similar to FIG. 12 with the coupling link retracted allowing the panel to be demounted from the base, FIG. 14 is a sectional elevation of the panel-link-base arrangement for the configuration of FIG. 12, FIG. 15 is a sectional elevation of the panel-link-base arrangement for the configuration of FIG. 13, FIG. 16 is an enlarged fragmentary view of the link connection of FIG. 12 between the base and a panel, with the panel retained in an upright operative relationship with the base by coupling means, FIG. 17 is a view similar to FIG. 16 where the panel is disengaged from its coupling means but still erect, and FIG. 18 is a view similar to FIG. 16 where the panel is disengaged from its coupling means but folded down into an overlying relationship with the base.

DETAILED DESCRIPTION OF THE DRAWINGS.

As background to the way in which the present invention relates to fold down side containers, and to facilitate an understanding of the present invention, the following description repeats a large part of the description of Australian patent 694001.

As illustrated the base 1 of FIG. 1 is made of metal and includes elements making it a "pallet" type base for the container. It is to be understood that the base need not be of the pallet type. The base 1 has two parallel sides 2,3 and a bearer 4 there between. The bottom edges of the sides 2 and 3 and the bearer 4 are connected by several transverse battens 5, only one of which is shown in FIG. 1. A load supporting floor panel 6 is provided. The sides 2,3 above the floor panel 6 are parts of box sections forming rails 7 each with an inner skin 8 and a top 9.

Extending the length of each rail top 9 there is a strip spaced above the rail top 9 to form channels 13 and there are like strips located at the edges of the base between the rails 7 to provide channels 14. At each corner of the base there are upstanding angle legs 10 forming part of the rails 7.

Four panels (as per FIGS. 2 and 3) are coupled to the base 1 by link means. The panels are in pairs (see FIG. 3) with oppositely disposed panels 15,16 of one pair coupled by links 11 to the legs 10 (see FIGS. 4 to 6) and the panels 17,18 are oppositely disposed and are coupled to the inner skins 8 of the rails 7 by like links 11. Each panel is preferably formed from a frame of angle iron members with out-turned flanges and an attached inner cladding sheet 20. It is to be noted that the panels 15,16 have a height less than that of the panels 17,18 for reasons which will become clear from the following detailed description. As will be seen from FIG. 2 the panel 17 is provided with slide bolts 21 for engagement in holes 22 in the frames of the panels 15,16. The side bolts 21 (provided on both panels 17 and 18) and the holes 22 provide securing means, as will be later described.

The container in an erected condition is shown in FIG. 3 where the flanges 19 of the upright sides of the panels 17 (and 18) are engaged with the hooks 23 to provide a coupling means for the erected panels. Securing means to secure the panels in coupled relationship is provided by entry of the slide bolts 21 into the holes 22.

The collapsed condition of the container is shown in FIG. 10 with the panels folded down and in overlying relationship, each with the other and all with respect to the base 1. This relationship is made possible by the links 11. The function of the links 11 as part of the folding and erecting process for the panels will now be described with reference to FIGS. 4 to 6.

In the panel erected condition the flange 40 of the bottom frame member of the side 17 is engaged in the channel 14. The links 11 at the opposite edges of the panel 17 are top connected to pins 12 on the inner skin 8 of the rails 7 and are bottom connected to the pins 28 on opposite upright side edges of the panel 17, see FIG. 4. In a typical panel collapsing sequence the panel 17 is first moved in the direction of the arrow A, normal to the plane of the panel, with arcuate movement of the link 11 about the two pivot pins 12 and 28. In the case of the panels 15 and 16 the pins 12 are fixed to the legs 10. FIG. 5 shows the panel 17 withdrawn so the panel bottom flange 40 is free of the channel 14. The notch 26 in the panel upright houses the pin 12 when the panel is in the FIG. 4 position.

FIG. 6 illustrates the arrangement of the components when the panel 17 is folded down (full lines) and when tilted and raised (broken lines) ready for lowering to the full line position or as will be the elevation of the opposite panel 18 when it is folded down to overlie the panel 17.

By following the folding down sequence of FIGS. 4 to 6 in the sequence shown in FIGS. 7 to 9 the collapsed configuration of FIG. 10 can be achieved. The security of the connection of the panels to the base and the simplicity of the erection and collapsing sequences can be readily seen from the drawings provided.

Where a lid is required a suitable lid can be designed to co-operate with the panels of the container and to that end the bracket 25 with a hole therein is shown on the top rail of the panel 17 in FIG. 3.

Whilst an "L" shaped link is shown a straight link can be used. In the case of a straight link the link accommodating notch 27 in the flange 40 of the panel 17 would have to be deeper than that shown in FIG. 6 for use with an "L" shaped link 11.

The present invention involves replacing the links 11 with a different form of link identified 41 in FIGS. 11 to 18. The link 41 has an elongated bent body 42 made from round cross-section rod with a top and bottom out turned parallel spigots 43 and 44 with the spigot 43 longer than the spigot 44. There is a loose collar 45 on the spigot 43 and a compression spring 46 lies between the collar 45 and a retainer 47 on the spigot 43.

In use the collar 45 is fixed to the end of a sleeve 48 with a bore sufficiently large to allow the spring 46 and retainer 47 to slide in the bore. This can be seen from sectional views FIGS. 14 and 15. In FIG. 14 the link 41 is shown in the retracted condition with the spring 46 exerting pressure to maintain the link 41 in the illustrated position with the spigot 44 engaged in an elongated saddle 49 on the side panel 17.

FIG. 15 illustrates the uncoupling process involving spring compressing movement of the link 41 in the direction of the arrow A to release the spigot 44 from the saddle 49. It follows that movement of both links will allow the side panel to be demounted from the base.

As shown in FIG. 17, in a panel folding sequence, the panel 17 is first moved in the direction of the arrow B with pivotal movement of the link spigot 43 in the collar 45 and the link spigot 44 in the elongated saddle 49. A similar arrangement are provided for the panels 15, 16 and 18.

FIG. 17 shows the panel flange 40 withdrawn from the channel 14 so the panel is free of the channel and rests on the floor panel 6 as a result of the movement of the link spigot 44 along the opening in the saddle 49. This movement also allows the panel 17 to be folded down flat onto the panel 6 as shown in full lines in FIG. 18. The dotted outline is of the panel 17 prior to lowering into overlying relationship with the panel 6 and also represents the elevation of the panel 18 when folded down onto the panel 17.

The general panel erection procedure is the reverse of the fold down procedure as shown in FIGS. 7 through 10, and individually as shown in FIGS. 4 through 6, and FIGS. 16 through 18.

The foregoing is a presently preferred embodiment of the invention and it is to be understood that, for example, non-inventive changes can be made to the manner of resiliently biassing the links 41 to the FIGS. 12 and 13 condition, without departing from the inventive concepts hereinbefore disclosed and hereinafter claimed. Another modification might be the manufacture of the links 41 from other than round section rod.

It is to be understood that whilst the foregoing description has inferred that all four side panels of the container are secured to the base by releasable links the invention applies to the mounting of one side panel by such links and the other panels my have the link arrangements of Australian patent 694001.

What is claimed is:

1. A collapsible container including a four sided base, four side panels connected respectively to the four sides of the base each by a pair of links allowing the side panels to be folded down from an erect position upstanding from the base into overlying relationship with each other and the base, the links of at least one side panel being releasable links allowing said one side panel to be demounted from the base, each releasable link includes a body with a first spigot and a second spigot with the spigots substantially parallel and extending in the same direction away from the body, the first spigots of said releasable links are respectively permanently engaged in bearing means on said base in a manner allowing the first spigots to pivot in said bearing means and to move in said bearing means in a direction aligned with the axis of pivoting of said first spigots, the second spigots of said releasable links are respectively engaged in tracks of said one side panel in a manner allowing said second spigots to pivot in said tracks and move along said tracks in a direction lateral to the axis of pivoting of said second spigots and to be axially withdrawn from said tracks, and biassing means for each of said releasable links to bias said first spigots to inner positions in said bearing means corresponding with engaged positions for said second spigots in said tracks, said second spigots being disengaged from said tracks to allow demounting of said one side panel from said base by axial movement of said first spigots towards outer positions in said bearing means against said biassing means.

2. A collapsible container as claimed in claim 1 wherein said biassing means for each first spigot is a coil spring though which said first spigot passes, the spring being located between shoulder means on said first spigot and shoulder means of said bearing means.

3. A collapsible container as claimed in claim 2 wherein said bearing means includes a member fixed to the base and having a through bore which is stepped to provide a smaller diameter part to receive and bearingly support said first spigot, and a larger diameter part to house said coil spring disposed between a collar on said first spigot and a step in said bore separating the bore smaller and larger diameter parts.

4. A collapsible container as claimed in claim 1 wherein the releasable links are formed from circular cross-section steel bar.

* * * * *